US006685511B2

(12) United States Patent
Akama et al.

(10) Patent No.: US 6,685,511 B2
(45) Date of Patent: Feb. 3, 2004

(54) BALANCED-TRANSMISSION CABLE-AND-CONNECTOR UNIT

(75) Inventors: Junichi Akama, Tokyo (JP); Hirofumi Yanagisawa, Tokyo (JP)

(73) Assignee: Fujitsu Takamisawa Component Ltd., Tokyo (JP)

( * ) Notice: Subject to any disclaimer, the term of this patent is extended or adjusted under 35 U.S.C. 154(b) by 61 days.

(21) Appl. No.: 09/962,241

(22) Filed: Sep. 26, 2001

(65) Prior Publication Data

US 2002/0009906 A1 Jan. 24, 2002

Related U.S. Application Data

(62) Division of application No. 09/187,733, filed on Nov. 9, 1998, now Pat. No. 6,336,827.

(30) Foreign Application Priority Data

Aug. 20, 1998 (JP) ..... 10-234708

(51) Int. Cl.[7] ..... H01R 9/03

(52) U.S. Cl. ..... 439/610; 439/608; 439/108; 439/941

(58) Field of Search ..... 439/610, 941, 439/608, 108

(56) References Cited

U.S. PATENT DOCUMENTS 4,762,500 A 8/1988 Dola et al.
5,122,065 A 6/1992 Dudek et al.
5,174,770 A * 12/1992 Sasaki et al. ..... 439/108
5,176,538 A * 1/1993 Hansell, III et al. ..... 439/607
5,195,899 A 3/1993 Yatsu et al.
5,364,292 A * 11/1994 Bethurum ..... 439/610
5,584,708 A 12/1996 Leong
5,645,436 A 7/1997 Shimizu et al.
5,848,914 A 12/1998 Lang et al.
5,934,942 A 8/1999 Patel
5,947,753 A 9/1999 Chapman et al.
5,953,213 A 9/1999 Napierala
6,135,818 A 10/2000 Lang et al.
6,250,936 B1 * 6/2001 Armistead et al. ..... 439/98

OTHER PUBLICATIONS

Akama, Junichi et al., "High Density Connector for Differential Data Transfer", 30th Annual Connector and Interconnection Symposium and Trade SHow, Anaheim, California, Sep. 22–24, 1997, pp. 277–282.

Akama, Junichi et al., "High Density Connector for Differential Data Transfer", Technical Report of IEICE (Oct. 1997), pp. 25–29.

* cited by examiner

*Primary Examiner*—Truc Nguyen
(74) *Attorney, Agent, or Firm*—Staas & Halsey LLP

(57) ABSTRACT

A balanced-transmission cable-and-connector unit includes a junction substrate, a plug for balanced transmission connected to one end of the junction substrate, a cable for balanced transmission connected to the other end of the junction substrate, and a shielding cover covering the junction substrate, a portion of the plug at which the plug is connected to the junction substrate and a portion of the cable at which the cable is connected to the junction substrate. The plug includes a pair of first and second signal contacts, and the length of a first signal transmitting path from the first signal contact to the cable via the junction substrate is substantially equal to the length of a second signal transmitting path from the second signal contact to the cable via the junction substrate.

16 Claims, 11 Drawing Sheets

BALANCED-TRANSMISSION CABLE-AND-CONNECTOR UNIT

CROSS-REFERENCE TO RELATED APPLICATIONS

This application is a divisional of application Ser. No. 09/187,733, filed Nov. 9, 1998, now pending.

BACKGROUND OF THE INVENTION

Field of the Invention

The present invention relates to a unit of connectors and a cable in which the connectors are connected with both ends of the cable, respectively, the unit having an arrangement such as to be used for balanced transmission. Hereinafter, such a unit will be referred to as a balanced-transmission cable-and-connector unit. In particular, the present invention relates to a balanced-transmission cable-and-connector unit used for connecting a computer with a peripheral device.

With the recent development of personal computers and networks thereof, systems are required for transmitting a large amount of data of, especially, dynamic images. In order to transmit a large amount of dynamic image data, it is necessary to transmit data at a high data transmission rate, not less than 1 gigabit/sec.

In the related art, unbalanced transmission is widely used in view of cost merit and so forth. However, because unbalanced transmission is likely to be affected by noise, it is considered that balanced transmission, which is less affected by noise, will be used in high-speed data transmission.

For connecting a personal computer with a peripheral device, a cable-and-connector unit, in which unit the connectors are connected with both ends of the cable, is used. It is therefore necessary to develop a cable-and-connector unit suitable for balanced transmission.

However, the cable-and-connector unit in the related art for connecting a personal computer with a peripheral device has a structure suitable for unbalanced transmission.

Thus, the cable-and-connector unit in the related art is not suitable for balanced transmission.

SUMMARY OF THE INVENTION

An object of the present invention is to provide a balanced-transmission cable-and-connector unit in which the problem described above is eliminated.

The above-mentioned object of the present invention is achieved by a balanced-transmission cable-and-connector unit which comprises:

a junction substrate;

a plug for balanced transmission connected to one end of the junction substrate;

a cable for balanced transmission connected to the other end of the junction substrate; and a shielding cover covering the junction substrate, a portion of the plug at which the plug is connected to the junction substrate and a portion of the cable at which the cable is connected to the junction substrate, wherein:

the plug includes a pair of first and second signal contacts; and the length of a first signal transmitting path from the first signal contact to the cable via the junction substrate is substantially equal to the length of a second signal transmitting path from the second signal contact to the cable via the junction substrate.

As a result of the length of the first signal transmitting path from the first signal contact to the cable via the junction substrate being substantially equal to the length of the second signal transmitting path from the second signal contact to the cable via the junction substrate, a time difference (skew) between a '+' signal and a '−' signal, which are transmitted in a manner of balanced transmission, does not occur, the magnitude of the '−' signal being equal to the magnitude of the '+' signal but the direction of the '−' signal being reverse to the direction of the '+' signal. As a result, the balanced-transmission cable-and-connector unit can be used for transmitting a high-speed signal of more than 1 gigabit/sec. with high reliability.

A balanced-transmission cable-and-connector unit, according to another aspect of the present invention, comprises:

a junction substrate;

a plug for balanced transmission connected to one end of the junction substrate;

a cable for balanced transmission connected to the other end of the junction substrate; and a shielding cover covering the junction substrate, a portion of the plug at which the plug is connected to the junction substrate and a portion of the cable at which the cable is connected to the junction substrate, wherein:

the plug includes a pair of first and second signal contacts;

the cable includes a plurality of sub-cables, the plurality of sub-cables being exposed from the end of the cable and connected to the end of the junction substrate; and the length of a first signal transmitting path from the first signal contact to the cable via the junction substrate and an exposed sub-cable of the plurality of sub-cables is substantially equal to the length of a second signal transmitting path from the second signal contact to the cable via the junction substrate and another exposed sub-cable of the plurality of sub-cables.

As a result of the length of the first signal transmitting path from the first signal contact to the cable via the junction substrate and the exposed subcable of the plurality of sub-cables being substantially equal to the length of the second signal transmitting path from the second signal contact to the cable via the junction substrate and the other exposed sub-cable of the plurality of sub-cables, a time difference (skew) between the '+' signal and the '−' signal, which are transmitted in the manner of balanced transmission, does not occur. As a result, the balanced-transmission cable-and-connector unit can be used for transmitting a high-speed signal of more than gigabit/sec. with high reliability.

A balanced-transmission cable-and-connector unit, according to another aspect of the present invention, comprises:

a junction substrate;

a plug for balanced transmission connected to one end of the junction substrate;

a cable for balanced transmission connected to the other end of the junction substrate; and a shielding cover covering the junction substrate, a portion of the plug at which the plug is connected to the junction substrate and a portion of the cable at which the cable is connected to the junction substrate, wherein:

the plug comprises a housing made of synthetic resin and alternately arranged ground contacts and pairs of signal contacts, each pair of the pairs of signal contacts having first and second leg portions between which the end of the junction substrate is inserted, the lengths of the first and second leg portions of each pair of the pairs of signal contacts being equal to one another;

the cable comprises a tube-shaped outer covering portion, a tube-shaped sub-cable shielding portion provided inside the outer covering portion, a plurality of sub-cables circularly arranged along the inner surface of the sub-cable shielding portion and a filler portion filling a portion of the cable inside the plurality of sub-cables, each of the plurality of sub-cables comprising a pair of leads for balanced transmission and a lead shielding portion shielding the pair of leads;

the junction substrate has a multi-layer structure and has ground lands on the obverse surface and the reverse surface at one end thereof, the lead shielding portions being soldered to the ground lands, the junction substrate further having pairs of signal pads on the obverse surface and the reverse surface at the other end thereof, each pair comprising one pad on the obverse surface and the other on the reverse surface, the junction substrate further having pairs of lead connection pads on the obverse surface and the reverse surface thereof between the ground lands and the pairs of signal pads, each pair of the pairs of signal pads having the leads of the respective one of the plurality of sub-cables soldered thereto, the junction substrate further having first wiring connecting one pad of each pair of the pairs of lead connection pads with the obverse-surface-side pad of the respective pair of the pairs of signal pads using an internal layer of the junction substrate and second wiring connecting the other pad of each pair of the pairs of lead connection pads with the reverse-surface-side pad of the respective pair of the pairs of signal pads using another internal layer of the junction substrate, the length of the first wiring being substantially equal to the length of the second wiring;

the first and second leg portions of each pair of the pairs of signal contacts of the plug has the junction substrate inserted therebetween, and two leg portions of each of the ground contacts of the plug has the junction substrate inserted therebetween, the first leg portion of each pair of the pairs of signal contacts being soldered to the obverse-surface-side pad of the respective pair of the pairs of signal pads and the second leg portion of each pair of the pairs of signal contacts being soldered to the reverse-surface-side pad of the respective pair of the pairs of signal pads, thus the plug being connected with the end of the junction substrate;

the plurality of sub-cables exposed from the end of the cable are equally separated into sub-cables on the obverse-surface side of the junction substrate and sub-cables on the reverse-surface side of the junction substrate, the pair of leads of each of the plurality of sub-cables being soldered to the respective pair of the pairs of lead connection pads, respectively; and the shielding cover has shielding-plate portions at one end thereof and shielding-arm portions at the other end thereof, the shielding-plate portions being inserted into the plug and the shielding-arm portions being connected with the sub-cable shielding portion of the cable, thus the shielding cover being fastened to the plug and the cable.

Because the junction substrate has the multi-layer structure, and the first wiring and the second wiring use the internal layers, it is possible that the length of the first wiring is approximately equal to the length of the second wiring. Further, the sub-cables of the cable are arranged circularly, and also, the sub-cables exposed from the end of cable are equally separated into the sub-cables on the obverse-surface side of the junction substrate and the reverse-surface side of the junction substrate. As a result, it is possible that the lengths of the sub-cables exposed from the end of the cable are approximately equal to each other. Thereby, a time difference (skew) between the '+' signal and the '−' signal, which are transmitted in the manner of balanced transmission, does not occur. Further, a time difference (skew) between the signals transmitted through the plurality of sub-cables does not occur. As a result, the balanced-transmission cable-and-connector unit can be used for transmitting a high-speed signal of more than gigabit/sec. with high reliability.

Further, the shielding-plate portions are portions of the shielding cover and are not separate parts. Therefore, it is not necessary to increase the number of parts.

A plug for balanced transmission, according to the present invention, comprises:

a housing made of synthetic resin;

alternately arranged ground contacts and pairs of signal contacts; and two shielding plates incorporated into the housing oppositely, wherein:

each pair of the pairs of signal contacts has first and second leg portions between which an end of a printed-circuit board is inserted, the lengths of the first and second leg portions of each pair of the pairs of signal contacts being equal to one another; each of the ground contacts has leg portions between which the end of the printed-circuit board is inserted; and the two shielding plates have leg portions between which the end of the printed-circuit board is inserted.

Because each pair of the pairs of signal contacts has first and second leg portions between which the end of the printed-circuit board is inserted, it is possible that the plug for balanced transmission is connected to the printed-circuit board in a manner in which the printed-circuit board is located on the center line of the plug. Thereby, a time difference (skew) between the '+' signal and the '−' signal, which are transmitted in the manner of balanced transmission, does not occur.

A plug for balanced transmission, according to another aspect of the present invention, comprises:

a housing made of synthetic resin;

alternately arranged ground contacts and pairs of signal contacts; and two shielding members inserted into the housing oppositely, wherein:

each pair of the pairs of signal contacts has first and second leg portions between which an end of a printed-circuit board is inserted, the lengths of the first and second leg portions of each pair of the pairs of signal contacts being equal to one another;

each of the ground contacts has leg portions between which the end of the printed-circuit board is inserted; and the two shielding members have shielding plate portions which are inserted into the housing, and covering portions which cover the first and second leg portions of each pair of the pairs of signal contacts and the leg portions of each of the ground contacts when the shielding-plate portions are inserted into the housing.

Because each pair of the pairs of signal contacts has first and second leg portions between which the end of the printed-circuit board is inserted, it is possible that the plug for balanced transmission is connected to the printed-circuit board in a manner in which the printed-circuit board is located on the center line of the plug. Thereby, a time difference (skew) between the '+' signal and the '−' signal, which are transmitted in the manner of balanced transmission, does not occur.

Further, because the first and second leg portions of each pair of the pairs of signal contacts and the leg portions of each of the ground contacts are covered by the covering portions of the shielding members, the first and second leg portions of each pair of the pairs of signal contacts and the leg portions of each of the ground contacts are not likely to be affected by external electromagnetic noise.

Other objects and further features of the present invention will become more apparent from the following detailed description when read in conjunction with the accompanying drawings.

DETAILED DESCRIPTION OF THE PREFERRED EMBODIMENTS

Figure 1:
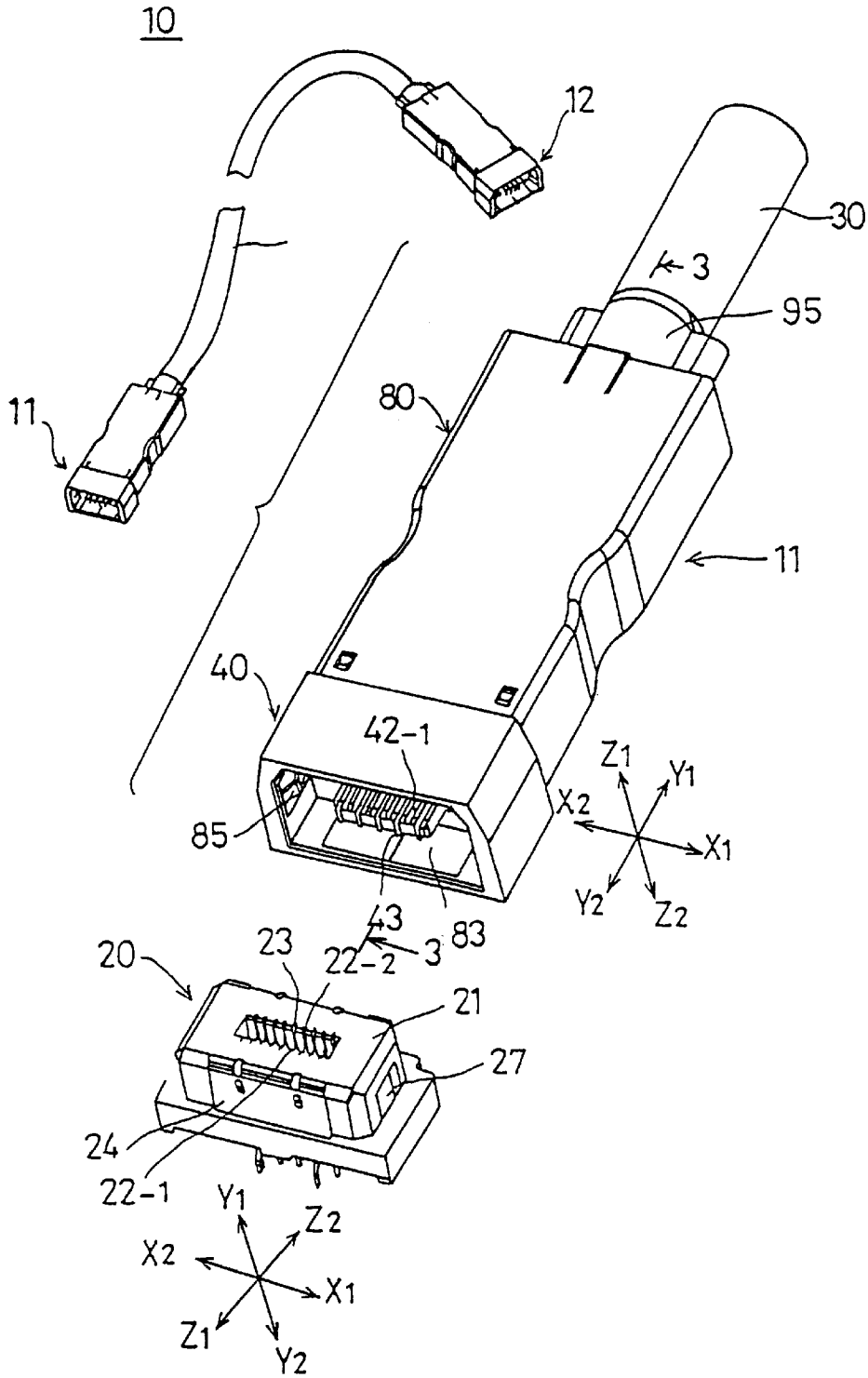
FIG. 1 shows a balanced-transmission cable-and-connector unit in one embodiment of the present invention.

FIG. 1 shows a balanced-transmission cable-and-connector unit 10 in one embodiment of the present invention. The balanced-transmission cable-and-connector unit 10 has an arrangement in which connectors 11, 12 for balanced transmission are connected with both ends of a cable 30 for balanced transmission. The connector 11 of one end is connected with a jack, for balanced transmission, of a personal computer. The connector 12 of the other end is connected with a jack, for balanced transmission, of a peripheral device. Thus, the balanced-transmission cable-and-connector unit 10 connects the personal computer with the peripheral device.

Figure 2:
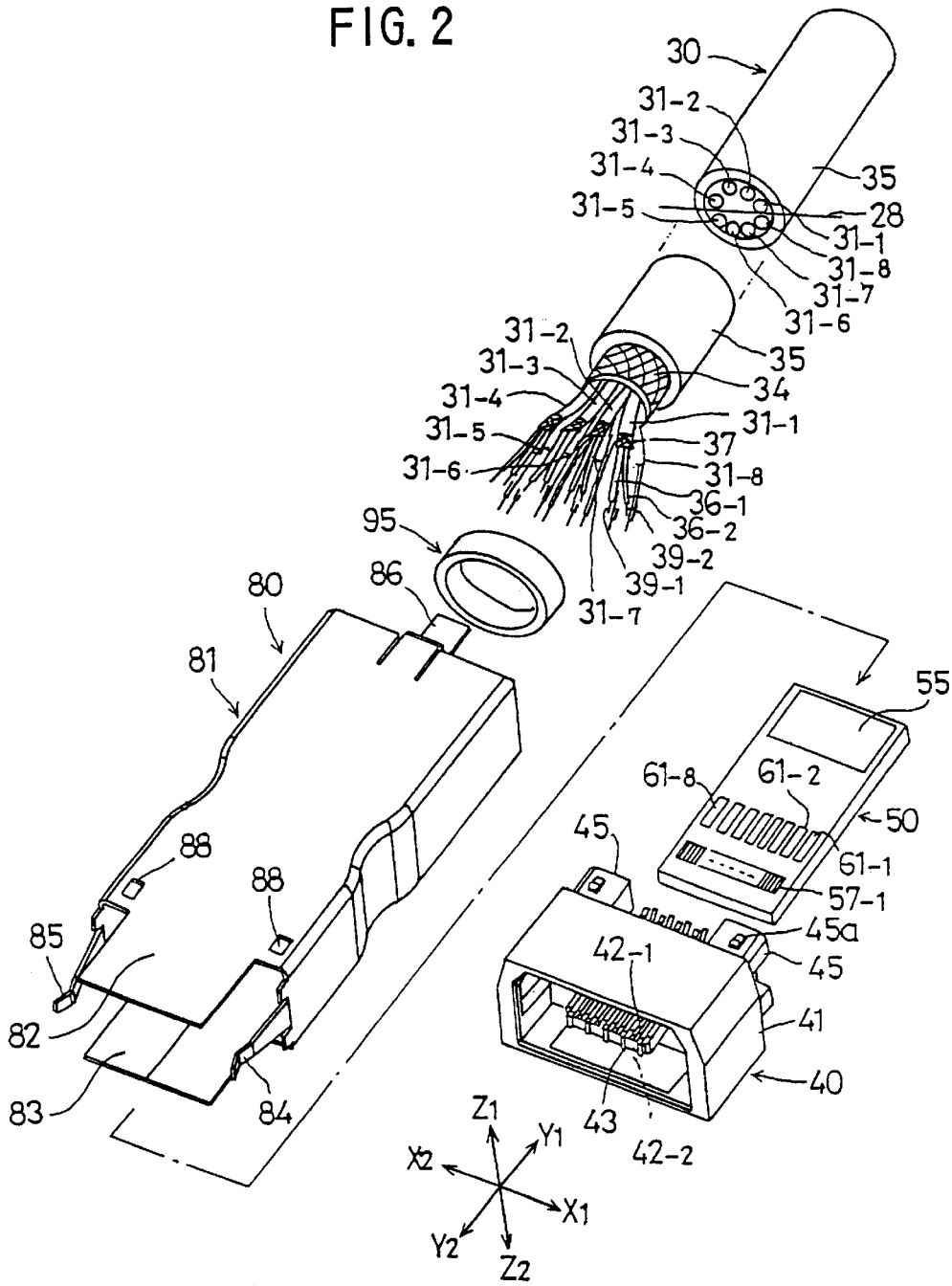
FIG. 2 shows an exploded perspective view of a portion of the balanced-transmission cable-andconnector unit shown in FIG. 1.

As shown in FIG. 2 in an exploded manner, an end portion of the balanced-transmission cable-and-connector unit 10 includes an end portion of the cable 30 for balanced transmission, a plug 40 for balanced transmission, a junction substrate 50, a shielding cover 80 and a caulking ring 95. In a sub-assembly 100, shown in FIG. 4, the plug 40 is connected to the Y2-direction end of the junction substrate 50, and the cable 30 is soldered to the Y1-direction end of the 30 junction substrate 50.

Figure 5:
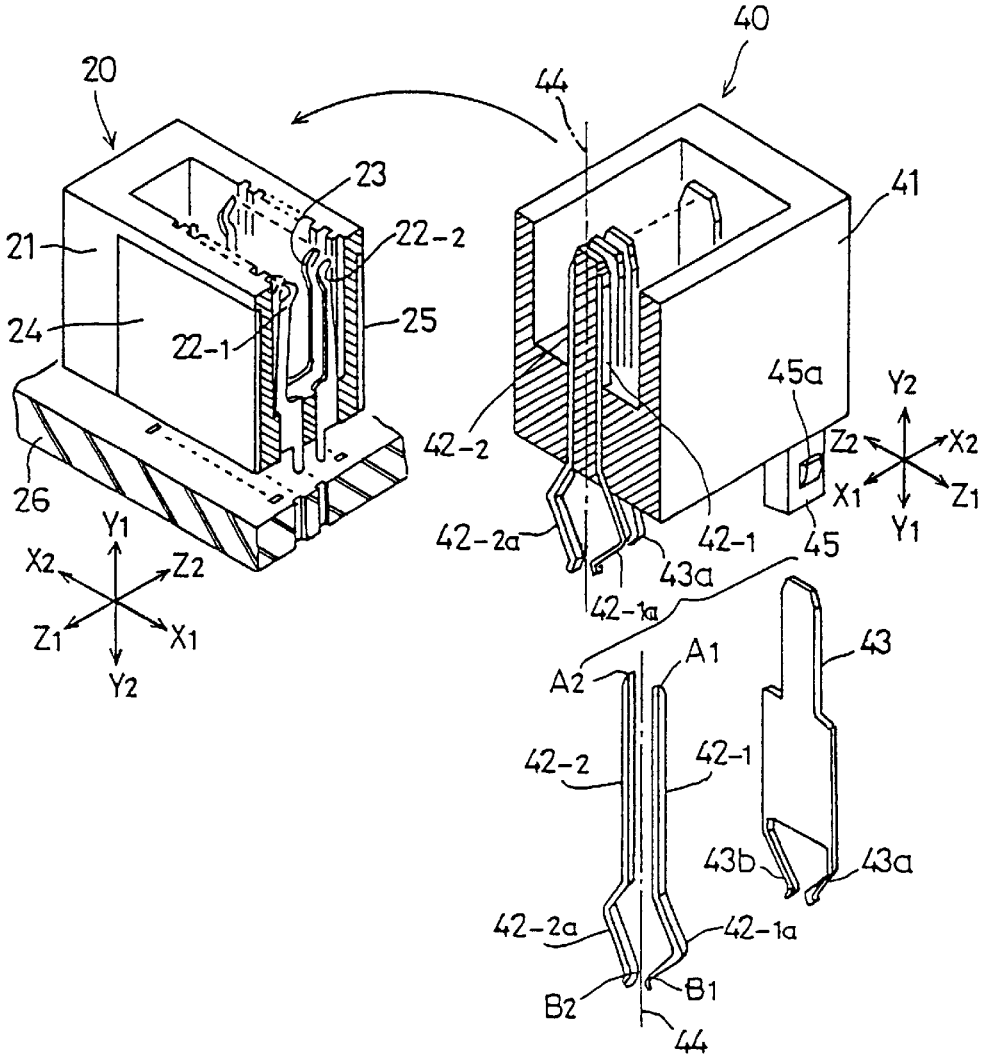
FIG. 5 shows the plug for balanced transmission of the balanced-transmission cable-and connector unit shown in FIG. 1 and a corresponding jack for balanced transmission.

In the jack 20 for balanced transmission, as shown in FIG. 5, pairs of jack-side signal contacts 221, 22-2 and ground contacts 23 are alternately arranged in the X1, X2 directions and put in a housing 21 made of synthetic resin and having a box-shape. Further, rectangular shielding plates 24, 25 each extending in the X1, X2 directions and Y1, Y2 directions are put in both sides of the housing 21. This jack 20 for balanced transmission is mounted on a printed-circuit board 26 inside the personal computer. The signal contacts 22-1, 22-2 are electrically connected with signal patterns of the printed-circuit board 26. The ground contacts 23 and the shielding plates 24, 25 are electrically connected with the ground of the printed circuit board 26. Each ground contact 23 has a size such that each ground contact 23 covers the X-direction 10 projected area of each pair of signal contacts 22-1, 22-2. As shown in FIG. 1, recess portions 27 are formed on X1, X2-direction end surfaces, in which recess portions 27 predetermined portions of the connector 11 are fitted.

As shown in FIG. 5, in the plug 40 for balanced transmission, pairs of first and second signal contacts 42-1, 42-2 and ground contacts 43 are alternately arranged at pitches corresponding to those in the jack 20 for balanced transmission and put in a 20 housing 41 made of synthetic resin and having a box shape. Each ground contact 43 has a size such that each ground contact 43 covers the X-direction projected area of each pair of signal contacts 42-1,42-2.

Each pair of signal contacts 42-1, 42-2 has leg portions 42-1*a*, 42-2*a* each projecting outside the housing 41. Each of the leg portions 42-1*a*, 42-2*a* has a V-shape, the leg portions-42-1*a*, 42-2*a* are symmetrical with respect to the center line 44 of the plug 40 for balanced transmission, and can hold the 30 junction substrate 50 therebetween. The length of the leg portion 42-1*a* is equal to the length of the leg portion 42-2*a*. The length between the end A1 of the first signal contact 42-1 and the extending end B1 of the leg portion 42-1*a* along the first signal contact 35 42-1 is equal to the length between the end A2 of the second signal contact 42-2 and the extending end B2 of the leg portion 42-2*a* along the second signal contact 42-2.

Each ground contact 43 has two leg portions 43*a*, 43*b*. The leg portions 43*a*, 43*b* extend so that the distance therebetween is smaller at the position thereof nearer to the Y1-direction ends thereof, and can hold the junction substrate 50 therebetween.

Figure 4:
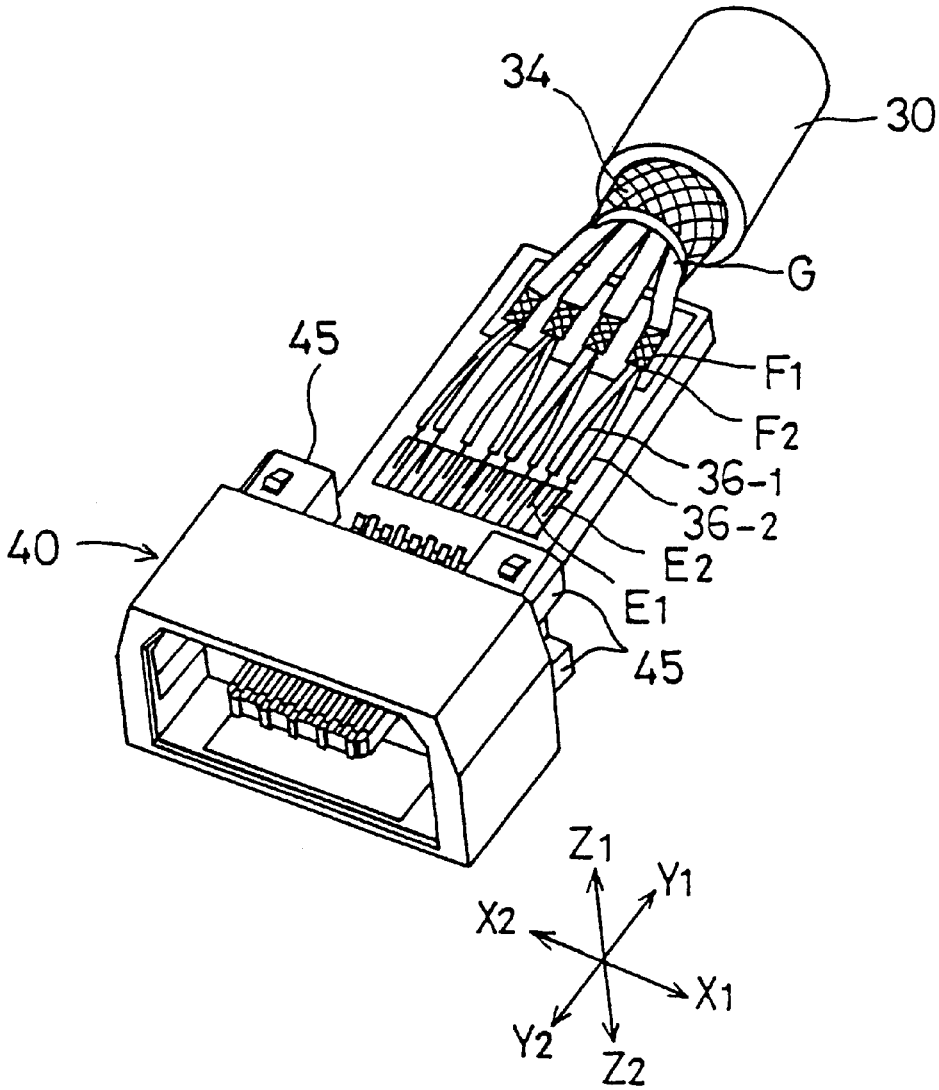
FIG. 4 shows a sub-assembly including a plug, a junction substrate and an end portion of a cable.

Further, as shown in FIG. 4, the housing 41 has arms 45 projecting from the four corners thereof in the Y1 direction. Each arm 45 has a movement 10 preventing claw 45*a* as shown in FIG. 5.

Figure 6:
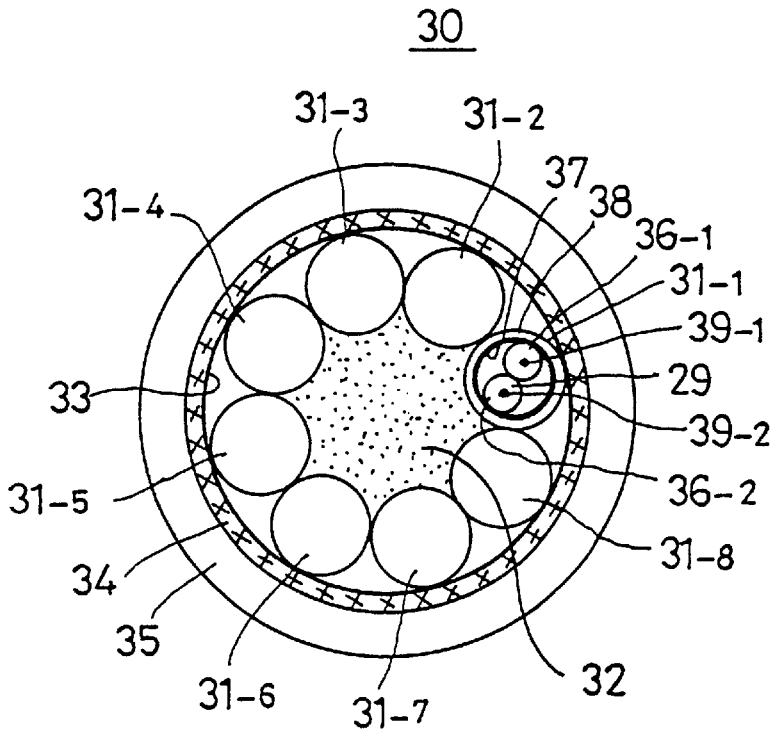
FIG. 6 shows a cross-sectional view of the cable for balanced transmission.

As shown in FIG. 6, in the cable 30 for balanced transmission, on a cross section perpendicular to the axis line, 8 sub-cables 31-1 through 31-8 are arranged so as to form a circle. In the cable 30, the 8 sub-cables 31-1 through 31-8 surround a central electrically insulating filler portion 32, are held by a holding winding portion (wrapping tape) 33, then, are covered by a sub-cable-group shielding mesh 34 for shielding the group of sub-cables, and, then, are covered by a tube-shaped electrically insulating outer covering portion. Because the 8 sub-cables 31-1 through 31-8 are arranged circularly, it is possible that the lengths of the sub-cables are equal to each other, when the sub-cables are exposed from the end of cable 30 and connection thereof is made separately.

Each of the sub-cables 33-1 through 33-8 includes a pair of first and second covered leads 36-1, 36-2 for balanced transmission, a lead shielding mesh 37 for covering the pair of first and second covered 30 leads 36-1, 36-2, and a holding winding portion (wrapping tape) 38 which covers the lead shielding mesh 37. Each of the first and second covered leads 36-1, 36-2 includes the respective one of first and second leads 39-1, 39-2, and a covering portion 29.

Figure 7A:
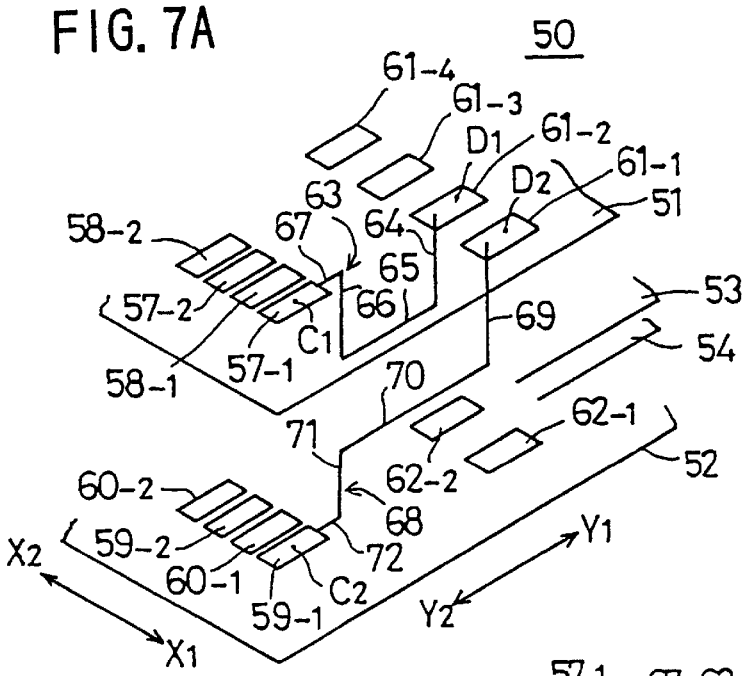
FIGS. 7A, 7B and 7C show a structure of the junction substrate.
Figure 7B:
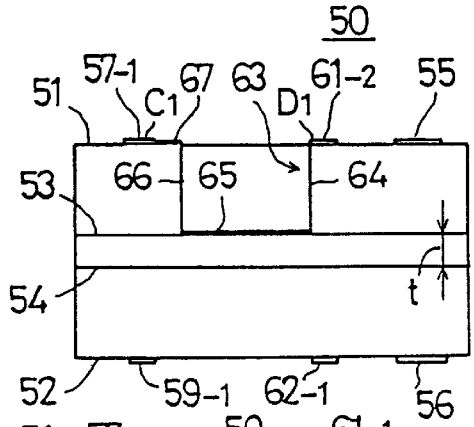
Figure 7C:
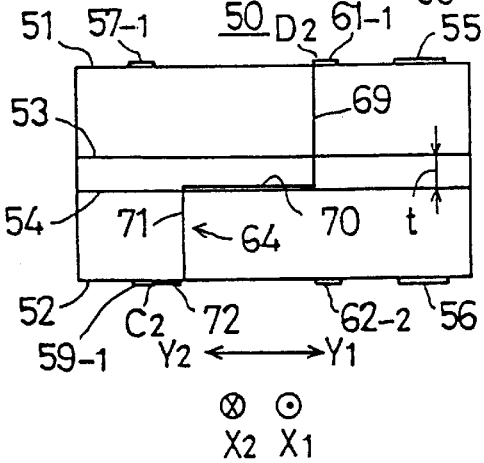

As shown in FIGS. 7A, 7B and 7C, the junction substrate 50 has a rectangular-shape which is long in the Y1, Y2 directions, and has a 4-layer structure including an obverse surface layer 51, a reverse surface layer 52, a first internal layer 53 and a second internal layer 54.

As shown in FIGS. 7B and 7C, ground lands 55, 56 to which the lead shielding meshes 37 are soldered are formed on the obverse surface layer 51 and on the reverse surface layer 52, at the Y1-direction end, respectively.

At the Y2-direction end on the obverse surface layer 51, signal pads and ground pads are arranged alternately in order of the signal pad 57-1, the ground pad 58-1, the signal pad 57-2, the ground pad 58-2, . . . , in the X2 direction. Identically, at the Y2-direction end on the reverse surface layer 52, signal pads and ground pads are arranged alternately in order of the signal pad 59-1, the ground pad 60-1, the signal pad 59-2, the ground pad 60-2, . . . , in the X2 direction. The signal pads 57-1 and 59-1 are used as a pair, the signal pads 57-2 and 59-2 are used as a pair. Thus, there are 8 pairs of signal pads. The ground pads 58-1, 58-2, . . . are connected with the ground land 55. The ground pads 60-1, 60-2, . . . are connected with the ground land 56.

At approximately middle in the Y1, Y2 direction on the obverse surface layer 51 of the junction substrate 50, lead connection pads 61-1, 612, . . . , 61-8 are formed side by side in the X1, X2 directions. The adjacent lead connection pads 61-1, 61-2 form a first pair, the subsequent adjacent lead connection pads 61-3, 61-4 form a second pair, . . . Identically, at approximately middle in the Y1, Y2 direction on the reverse surface layer 52 of the junction substrate 50, lead connection pads 62-1, 62-2, . . . , 62-8 are formed side by side in the X1, X2 directions. The adjacent lead connection pads 62-1, 62-2 are used as a pair, the subsequent adjacent lead connection pads 62-3, 62-4 are used as a pair . . . .

The pairs of lead connection pads are connected with the pairs of signal pads through wirings, respectively. Connection between the pair of lead connection pads 61-1, 61-2 and the pair of signal pads 57-1, 59-1 will now be described, for example.

The lead connection pad 61-2 and the signal pad 57-1 are connected by a first wiring 63. The first wiring 63 includes a via hole 64 extending from the lead connection pad 61-2 to the first internal layer 53, a wiring pattern 65 extending on the first internal layer 53 from the bottom end of the via hole 64, a via hole 66 extending from the wiring pattern 65 on the first internal layer 53 to the obverse surface layer 51, and a wiring pattern 67 extending from the top end 15 of the via hole 66 to the signal pad 57-1.

The lead connection pad 61-1 and the signal pad 59-1 are connected by a second wiring 68. The second wiring 68 includes a via hole 69 extending from the lead connection pad 61-1 to the second internal layer 54, a wiring pattern 70 extending on the second internal layer 54 from the bottom end of the via hole 69, a via hole 71 extending from the wiring pattern 70 on the second internal layer 54 to the reverse surface layer 52, and a wiring pattern 72 extending from the bottom end of the via hole 71 to the signal pad 59-1.

The distance 't' between the first and second internal layers 53 and 54 is small, that is, 0.1 through 0.2 mm. Accordingly, the length of the first wiring 63 is approximately equal to the length of the second wiring 68. That is, the length between the position C1 of the signal pad 57-1 and the position D1 of the lead connection pad 61-2 along the first wiring 63 is approximately equal to the length between the position C2 of the signal pad 59-1 and the position D2 of the lead connection pad 61-1 along the second wiring 68.

The other pairs of lead connection pads on the obverse surface layer 51 and the other pairs of lead connection pads on the reverse surface layer 52 are connected with the other pairs of signal pads, in manners each identical to the above-described manner, respectively.

The shielding cover 80 is made from a metal plate through press working and has a shape of a hollow, approximately square pole. The shielding cover 80 includes a body 81 having the shape of the hollow, approximately square pole shape, shielding-plate portions 82, 83 extending in the Y2 direction from the Z1, Z2-direction-end edges of the Y2-direction end of the body 81, locking-arm portions 84, 85 extending in the Y2 direction from the X1, X2-direction-end edges of the Y2-direction end of the body 81, shown in FIG. 2, shielding-arm portions 86, 87 extending in the Y1 direction from the Z1, Z2-direction-end edges of the Y1-direction end of the body 81, shown in FIGS. 2 and 3, and engaging openings 88 formed near the Y2-direction end of the body 81, shown in FIG. 2.

The sub-assembly 100 will now be described.

Figure 3:
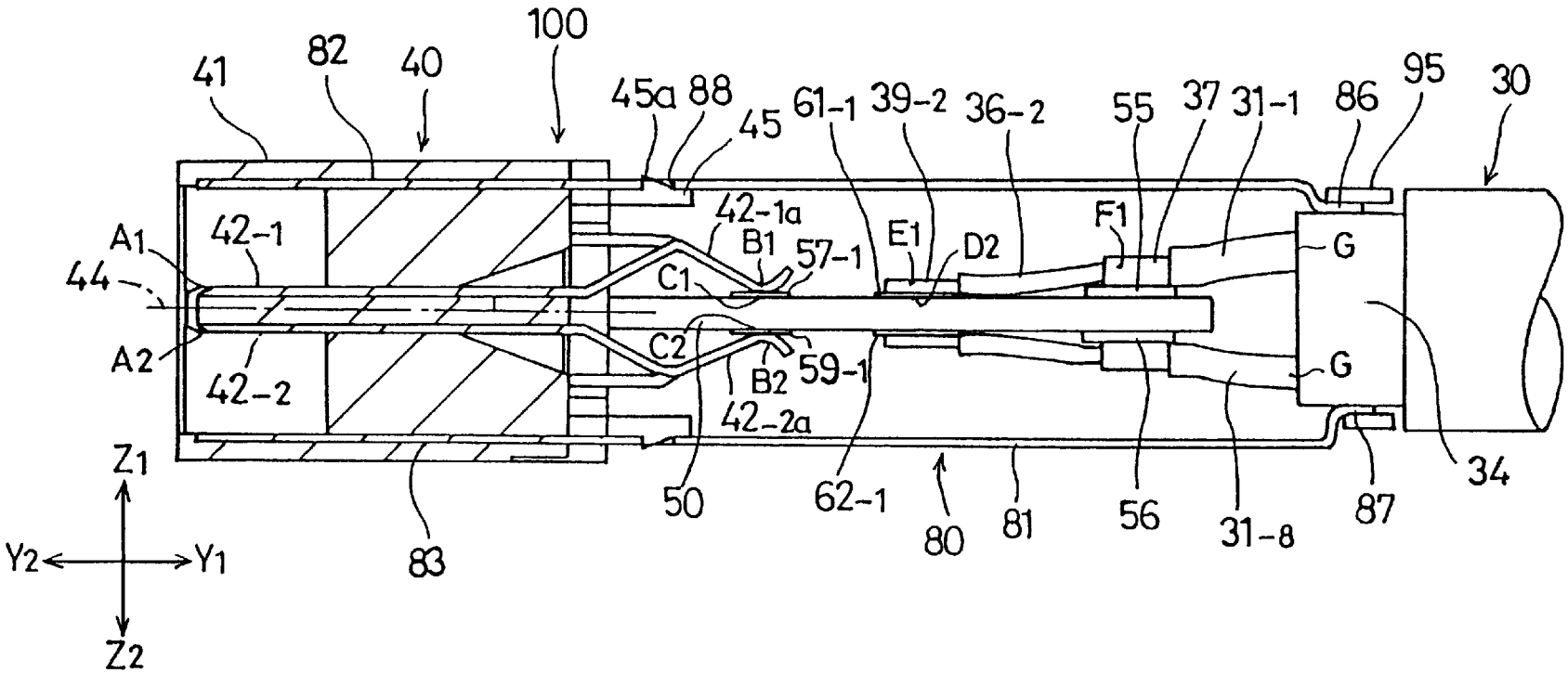
FIG. 3 shows a sectional view taken along the line 3—3 shown in FIG. 1.

As shown in FIG. 4, as described above, in the sub-assembly 100, the plug 40 for balanced transmission is connected to the Y2-direction end of the junction substrate 50, and the cable 30 for balanced transmission is connected with the Y1 direction end of the junction substrate 50. As shown in FIG. 3, the V-shaped leg portions 42-1*a*, 42-2*a* of the first and second signal contacts 30 42-1, 42-2 and the two leg portions 43*a*, 43*b* of the ground contacts 43 of the plug 40 for balanced transmission elastically hold the junction substrate 50 therebetween. In this condition, the leg portion 42-1*a* of the X1-direction-end first signal contact 42-1 is soldered to the signal pad 57-1, the leg portion 42-2*a* of the X1-direction-end second signal contact 42-2 is soldered to the signal pad 59-1, the leg portion 43*a* of the adjacent ground contact 43 is soldered to the ground pad 58-1, and the leg portion 43*b* the same ground contact 43 is soldered to the ground pad 60-1. Similarly, the other leg portions are soldered to the other signal pads and the other ground pads, respectively.

The junction substrate 50 is located on the center line 44 of the plug 40 for balanced transmission.

The end of the cable 3.0 for balanced transmission is processed as shown in FIG. 2. An end portion of the sub-cable-group shielding mesh 34 is exposed, and end portions of the 8 sub-cables 31-1 through 31-8 are exposed.

For each of the sub-cables 31-1 through 31-8, an end portion of the lead shielding mesh 37 is exposed, end portions of the first and second covered leads 36-1, 36-2 are exposed, and end portions of the first and second leads 39-1, 39-2 are exposed as a result of end portions of the covering portions 29 of the first and second covered leads 36-1, 36-2 being stripped.

The exposed 8 sub-cables 31-1 through 31-8 are separated, by the horizontal plane 28 (shown in FIG. 2) including the center line of the cable 30, into the upper-half 4 sub-cables 31-1 through 31-4 and the lower-half 4 sub-cables 31-5 through 31-8. The 4 sub cables 31-1 through 31-4 are aligned and extend to the side of the obverse surface layer 51 of the junction substrate 50, and the 4 sub-cables 31-5 through 31-8 are aligned and extend to the side of the reverse surface layer 52 of the junction substrate 50.

The 4 sub-cables 31-1 through 31-4 are arranged in the X1, X2 directions, and the respective lead shielding meshes 37 are soldered to the ground land 55 of the junction substrate 50. Thus, the sub cables 31-1 through 31-4 are connected to the junction substrate 50. The first and second covered leads 36-1, 1 36-2 of the sub-cable 31-1 extend in the Y2 direction along the obverse surface layer 51. The first lead 39-1 is soldered to the lead connection pad 61-2, and the second lead 39-2 is soldered to the lead connection pad 61-1. For the other sub-cables 31-2 through 31-4, the covered leads are aligned, and the exposed leads are soldered to the respective lead connection pads, in manners each identical to the above-described manner applied to the sub-cable 31-1. Identically, for the 4 sub-cables 31-5 through 31-8 on the reverse surface side, the respective lead shielding meshes 37 are soldered to the ground land 56 of the junction substrate 50, thus, the sub-cables 31-5 through 31-8 are connected to the junction substrate 50, the covered leads are aligned, and the exposed leads are soldered to the lead connection pads 62-2, 62-1, . . . .

Because the first and second covered leads 36-1, 36-2 extend symmetrically, the length between the position E1 of the exposed lead 39-1 and the position F1 of the lead shielding mesh 37 is equal to the length between the position E2 of the exposed lead 39-2 and the position F2 of the lead shielding mesh 37.

As mentioned above, the 8 sub-cables 31-1 through 31-8 are arranged so as to form the circle in the cable 30, and the 8 sub-cables 31-1 through 31-8 are separated by the horizontal plane 28 into the upper-half 4 sub-cables and the lower-half 4 sub cables. Thereby, the lengths of the respective sub cables 31-1 through 31-8 exposed from the end of the sub-cable-group shielding mesh 34 are approximately equal to each other. That is, the lengths between the positions G at the end of the exposed sub-cable-group shielding mesh 34 and the positions of the exposed lead shielding meshes 37 of the respective sub-cables are approximately equal to each other. Accordingly, the lengths of the first and second leads of all the sub cables 31-1 through 31-8 are approximately equal to each other.

In the above-described sub-assembly 100, paths through which a '+' signal and a '−' signal are transmitted will now be described.

With reference to FIG. 3, the length of the path between the position Al and the position G through which the '+' signal is transmitted, that is, the length of the path passing through the first signal contact 42-1, the first wiring 63, the exposed first covered lead 36-1 and the exposed sub-cable 31-1, and the length of the path between the position A2 and the position G through which the '−' signal is transmitted, that is, the length of the path passing through the second signal contact 42-2, the second wiring 68, the exposed second covered lead 36-2 and the exposed sub-cable 31-1, are approximately equal to one another. The difference therebetween corresponds to a signal transmission time difference which is equal to or less than a permissible error 100 ps/m.

Further, the lengths of the paths passing through the first and second signal contacts, the first and second wiring, the exposed first and second covered leads and the exposed sub-cables are approximately equal between the 8 sub-cables 31-1 through 31-8. The maximum difference therebetween corresponds to a signal transmission time difference which is equal to or less than a permissible error 150 ps/m.

When such a plug for balanced transmission is connected to an end of such a junction substrate, a general manner is such that a so-called right-angle-type plug for balanced transmission is mounted on the junction substrate. However, when the right-angle-type plug is used, a significant difference occurs in length between the first and second signal contacts. Therefore, the right-angle-type plug is not suitable for balanced transmission, and the above-described embodiment does not use the right-angle-type plug.

When the shielding cover 80 and the caulking ring 95 are integrated to the sub-assembly 100, the connector 11 for balanced transmission is completed. As shown in FIG. 3, the shielding cover 80 is coupled with the plug 40 for balanced transmission as a result of the Y2-direction end of the body 81 being fitted by the four-corner arm 45 of the plug 40, and the engaging openings 88 engaging with the movement-preventing claws 45*a*. The body 81 surrounds and covers the sub-assembly 100, and covers the junction substrate 50, a portion of the plug 40 for balanced transmission at which the plug 40 is connected with the junction substrate 50, and a portion of the cable 30 for balanced transmission at which the cable 30 is connected with the junction substrate 50.

The shielding-plate portions 82, 83 are inserted into the box-shaped housing 41 of the plug 40, and are located on the inner walls, of the housing 41, which walls face one another in the Z1, Z2 directions. The locking arms 84, 85 also are inserted into the housing 41, and are located on the inner walls of the housing 41, which walls face one another in the X1, X2 directions.

At the X1, X2-direction ends the caulking ring 95 are caulked (so that the caulking ring 95 comes to have the shape shown in FIG. 1), and, thereby, the shielding-arm portions 86, 87 are fastened to sub-cable-group shielding mesh 34 in a manner of crimping using the caulking ring 95. Thus, the Y1-direction end of the body 81 is fixed to the end of the cable 30.

The connector 11 for balanced transmission is connected with the jack 20 for balanced transmission as a result of the locking arms 84, 85 being fitted into the recess portions 27. The balanced-transmission cable-and-connector unit 10 provides 8 balanced-transmission paths between the personal computer and the peripheral device.

The connector 11 for balanced transmission and the balanced-transmission cable-and-connector unit have the following features and advantages:

The length of the path between the position Al and the position G through which the '+' signal is transmitted is substantially equal to the length of the path between the position A2 and the position G through which the '−' signal is transmitted, the magnitude of the '−' signal being equal to the magnitude of the '+' signal but the direction of the '−' signal being reverse to the direction of the '+' signal. Thereby, a time difference (skew) between the '+' signal and the '−' signal, which are transmitted in a manner of balanced transmission, does not occur. As a result, the balanced-transmission cable-and-connector unit 10 can be used for transmitting a high-speed signal of more than 1 gigabit/sec. with high reliability.

The lengths of the 8 balanced-transmission paths are substantially equal to each other. Thereby, a time difference (skew) between the 8 sorts of signals, which are transmitted through the 8 balanced-transmission paths in a manner of balanced transmission, does not occur. As a result, the balanced-transmission cable-and-connector unit 10 provides 8-channel transmission paths which can be used for transmitting 8 sorts of high-speed signals of more than 1 gigabit/sec. with high reliability.

Figure 8:
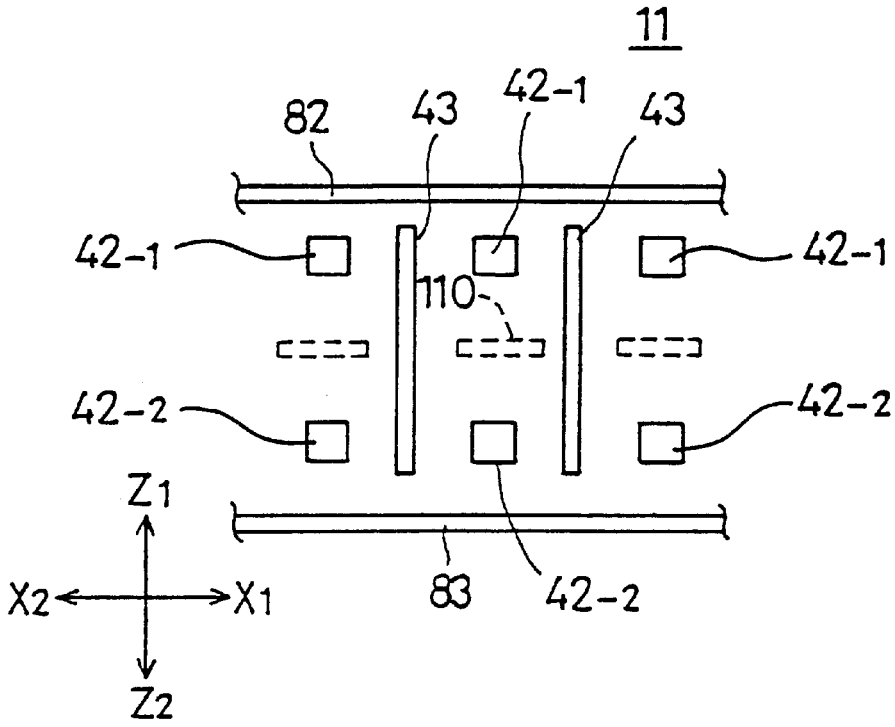
FIG. 8 shows a structure of a connector for balanced transmission of the balanced-transmission cable-and-connector unit shown in FIG. 1.

As shown in FIG. 8, in the connector 11 for balanced transmission, the ground contact 43 is inserted between each adjacent first signal contacts 42-1, 42-1 arranged side by side in the X1, X2 directions, and between each adjacent second signal contacts 42-2, 42-2 arranged side by side in the X1, X2 directions. Thus, a stripline structure is formed. Thereby, in the connector 11 for balanced transmission, occurrence of crosstalk between signals, which are transmitted through each adjacent signal contacts and each adjacent signal pads, arranged side by side in the X1, X2 directions, can be effectively restricted.

As shown in FIG. 8, an imaginary ground plane 110 is formed between each first and second signal contacts 42-1, 42-2 which are used as a pair for balanced transmission. As a result of the imaginary ground plane 110 being formed, occurrence of crosstalk between the '+' signal transmitted through the first signal contact 42-1 and the '−' signal transmitted through the second signal contact 42-2 can be effectively restricted.

The shielding-plate portions 82, 83 which are inserted into the housing 41 shield the first and second signal contacts 42-1, 42-2 from an external electromagnetic wave. Thereby, it is restricted that the '+' signals and the '−' signals transmitted through the first and second signal contacts 42-1, 42-2 in the manner of balanced transmission are affected by an electromagnetic wave outside the connector 11.

The shielding-plate portions 82, 83 are portions of the shielding cover 80 and are not separate parts. Therefore, it is not necessary to increase the number of parts.

The connector 12 for balanced transmission connected with the other end of the cable 30 for balanced transmission, shown in FIG. 1, has the same structure as the structure of the connector 11 for balanced transmission.

Figure 9A:
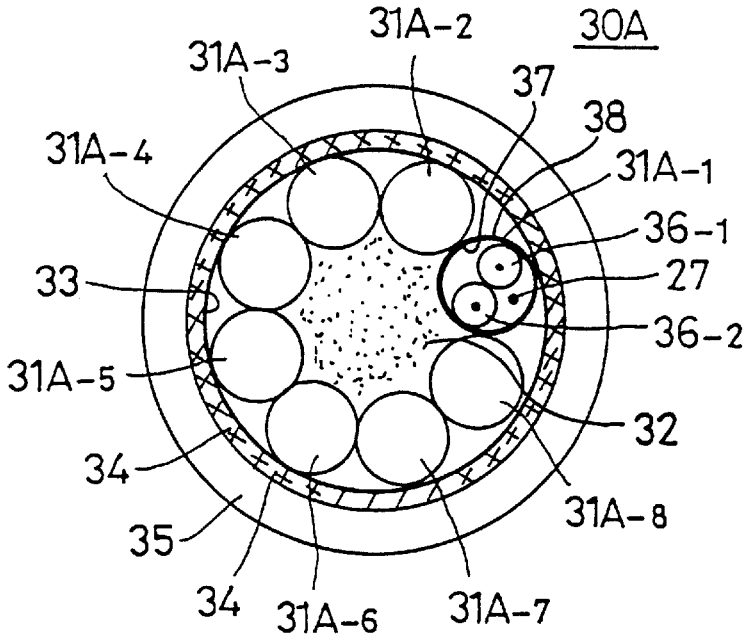
FIGS. 9A and 9B show variant embodiments of the cable for balanced transmission.
Figure 9B:
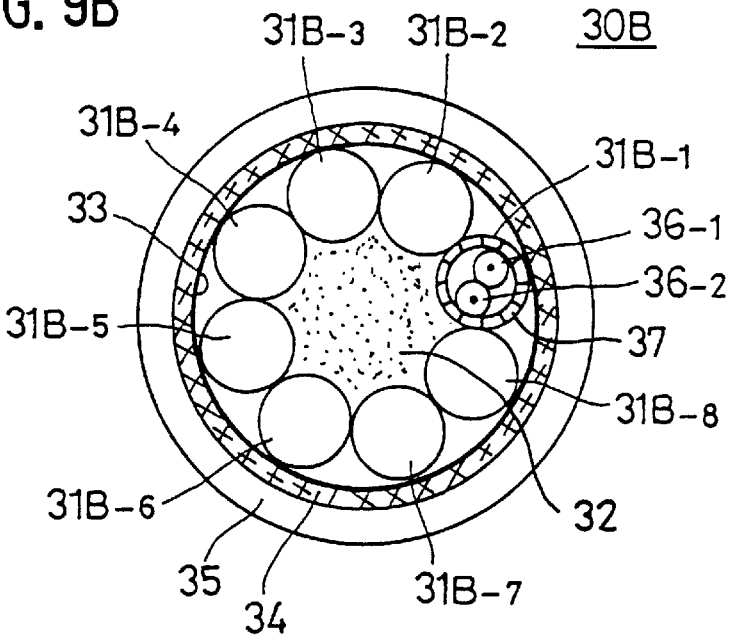

FIGS. 9A and 9B show variant embodiments of the cable 30 for balanced transmission. The same reference numerals are given to the same portions as those shown in FIG. 6, and description thereof will be omitted.

In a cable 30A for balanced transmission, shown in FIG. 9A, in each of sub-cables 33A-1 through 33A-8, a drain wire 27 is included in addition to the first and second covered leads 36-1, 36-2 which are used as a pair for balanced transmission. The drain wire 27 is in contact with the lead shielding mesh 37 in each sub-cable.

In a cable 30B for balanced transmission, shown in FIG. 9B, the holding winding portion 38 is omitted from each of the sub-cables 33B-1 through 33B-8.

FIGS. 10A,10B and FIGS. 11A, 11B show variant embodiments of the plug 40 for balanced transmission shown in FIGS. 2 and 5. In each figure, the same reference numerals are given to portions corresponding to those shown in FIGS. 2 and 5, and description thereof will be omitted.

Figure 10A:
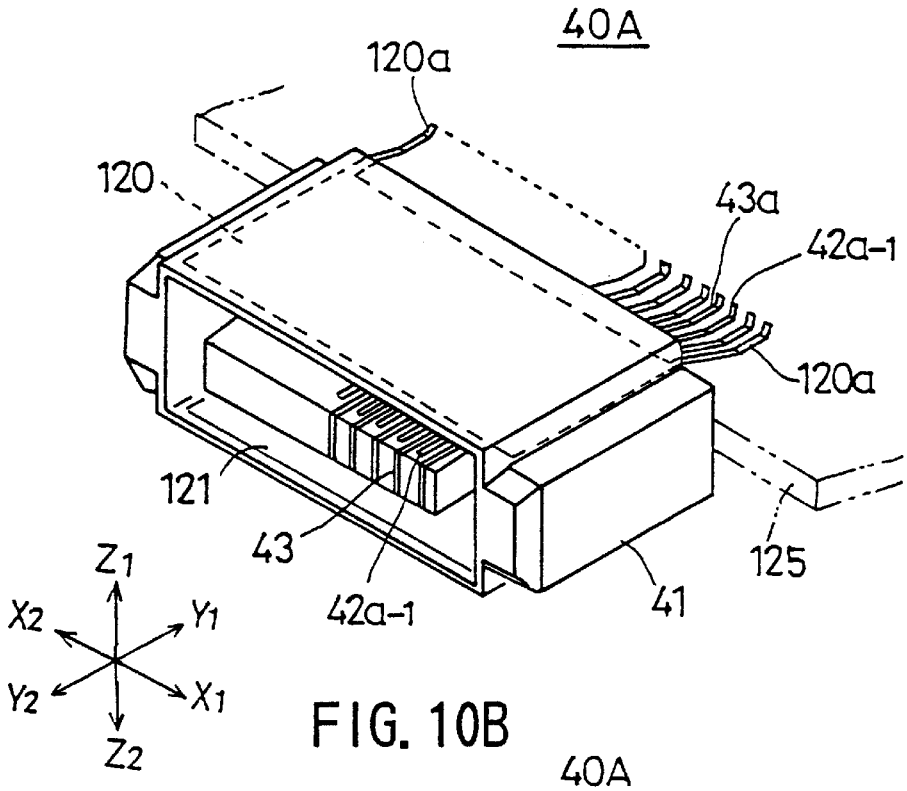
FIGS. 10A and 10B show a variant embodiment of the plug for balanced transmission.
Figure 10B:
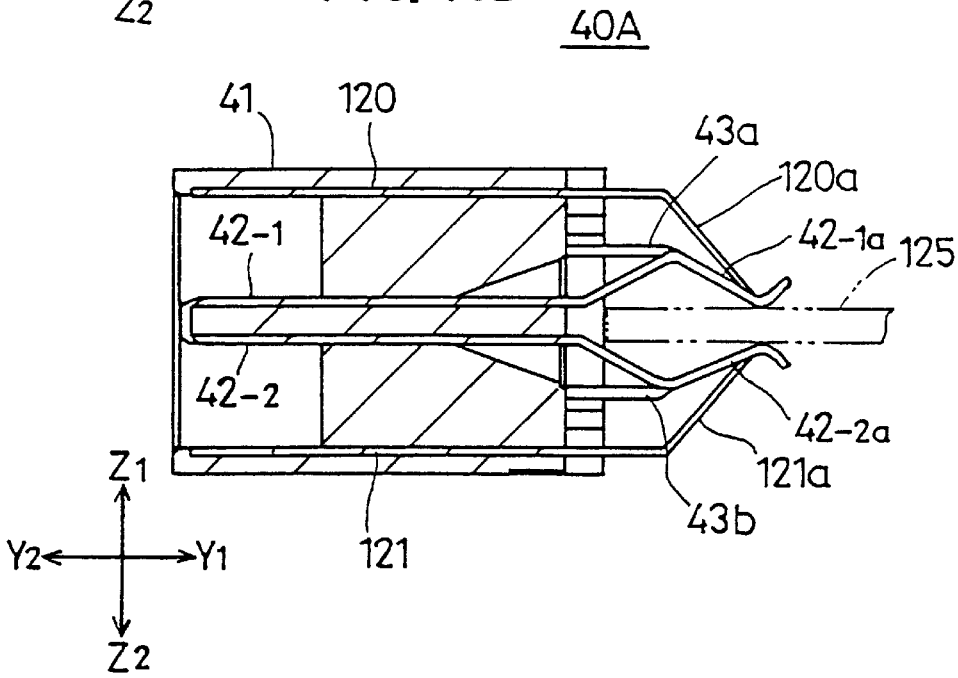

In a plug 40A for balanced transmission shown in FIGS. 10A and 10B, shielding plates 120, 121 are incorporated into the housing 41 on the top side and on the bottom side, respectively. The shielding plates 120 has legs 120*a* which project from both sides of the Y1-direction-end edge of the shielding plate 120 in the Y1 direction. The shielding plates 121 has legs 121*a* which project from both sides of the Y1-direction-end edge of the shielding plate 121 in the Y1 direction. The legs 120*a* of the top-side shielding plate 120 and the legs 121*a* of the bottom-side shielding plate 121 extend so that the distances between the legs 120*a* and legs 121*a* are shorter at the positions nearer to the projecting ends thereof.

The V-shaped leg portions 42-1*a*, 42-2*a* of each pair of first and second signal contacts 42-1, 42-2, the two leg portions 43*a*, 43*b* of each ground contact 43, and the legs 120*a* of the top-side shielding plate 120 and the legs 121*a* of the bottom-side shielding plate 121 elastically hold the printed-circuit board 125 therebetween. In this condition, the leg portions 42-1*a*, 42-2*a* of each pair of first and second signal contacts 42-1, 42-2, the two leg portions 43*a*, 43*b* of each ground contact 43, and the legs 120*a* of the topside shielding plate 120 and the legs 121*a* of the bottom-side shielding plate 121 are soldered to corresponding pads of the printed-circuit board 125. Thus, the plug 40A for balanced transmission is connected with an end portion of the printed-circuit board 125.

Figure 11A:
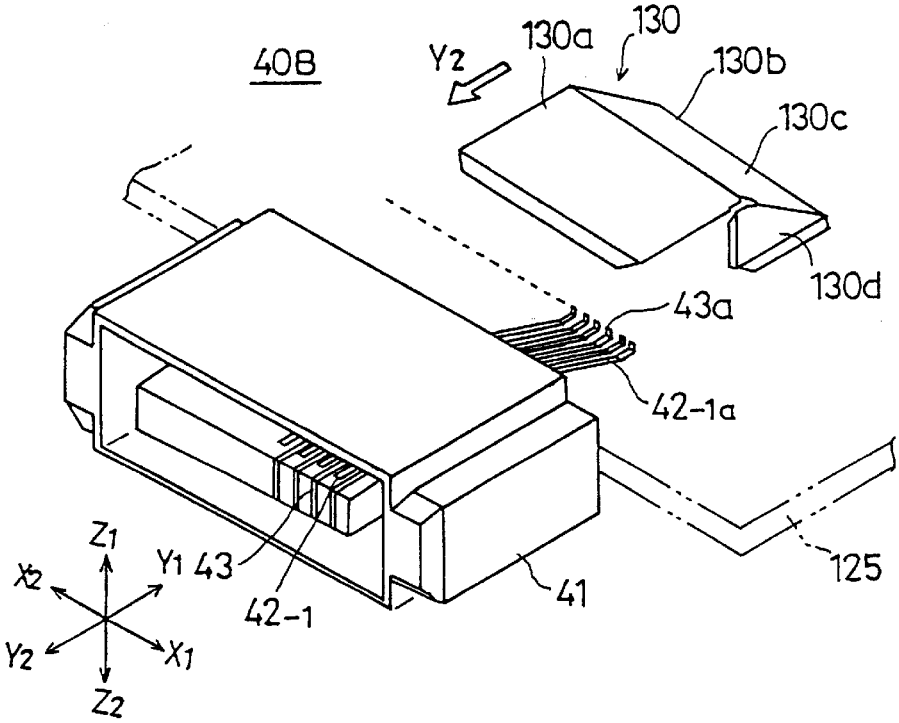
FIGS. 11A and 11B show another variant embodiment of the plug for balanced transmission.
Figure 11B:
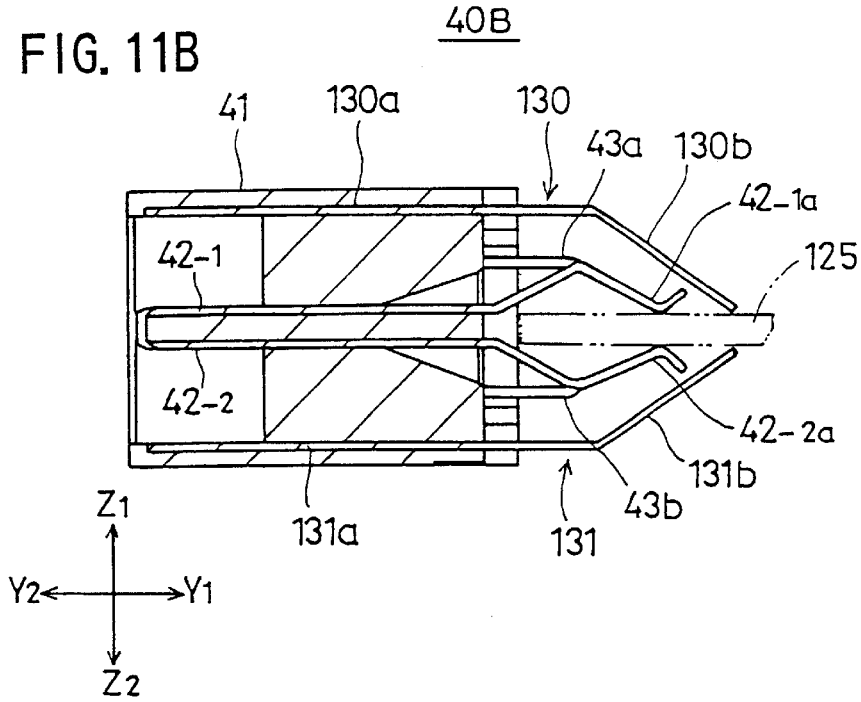

In a plug 40B for balanced transmission shown in FIGS. 1A and 11B, shielding members 130,131 are incorporated in the housing 41 instead of the above-described shielding plates 120, 121. The shielding members 130, 131 include shielding-plate portions 130*a*, 131*a*, and covering portions 130*b*, 131*b*, respectively. The covering portion 130*b* includes a hood portion 130*c* and side-plate portions 130*d* at both sides of the hood portion 130*c*. The covering portion 131*b* has the same structure. After the plug 40B for balanced transmission is connected with an end portion of a printed-circuit board 125, the shielding members 130, 131 are fasten to the plug 40B as a result of the shielding-plate portions 130*a*, 131*a* being press-fitted in the Y2 direction into the housing 41. As a result, the covering portions 130*b*, 131*b* covers the V-shaped leg portions 42-1*a*, 42-2*a* of each pair of first and second signal contacts 42-1, 42-2, and the two leg portions 43*a*, 43*b* of each ground contact 43. Thereby, the signals transmitted through the signal contacts are not likely to be affected by external electromagnetic noise.

Further, the present invention is not limited to the above-described embodiments, and variations and modifications may be made without departing from the scope of the present invention.

The contents of the basic Japanese Patent Application No.10-234708, filed on Aug. 20, 1998, are hereby incorporated by reference.

What is claimed is:

1. A balanced-transmission cable-and connector unit comprising:

a junction substrate;

a plug to balance transmission connected to one end of said junction substrate;

a cable to balance transmission connected to the other end of said junction substrate; and a shielding cover covering said junction substrate, a portion of said plug connected to said junction substrate and a portion of said cable connected to said junction substrate, wherein:

said cable comprises a plurality of sub-cables, each of which comprises a pair of leads to balance transmission, said plug comprises a pair of first and second signal contacts corresponding to the pair of leads of each of said plurality of sub-cables, respectively, and a length of a first signal transmitting path from said first signal contact to said cable via said junction substrate is substantially equal to a length of a second signal transmitting path from said second signal contact to said cable via said junction substrate.

2. A balanced-transmission cable-and connector unit comprising:

a junction substrate;

a plug to balance transmission connected to one end of said junction substrate;

a cable to balance transmission connected to the other end of said junction substrate; and a shielding cover covering said junction substrate, a portion of said plug connected to said junction substrate and a portion of said cable connected to said junction substrate, wherein:

said cable comprises a plurality of sub-cables, each of which comprises a pair of leads to balance transmission, said plug comprises a pair of first and second signal contacts corresponding to the pair of leads of each of said plurality of sub-cables, respectively, said plurality of sub-cables being exposed from the end of said cable and connected to said other end of said junction substrate, and a length of a first signal transmitting path from said first signal contact to said cable via said junction substrate and an exposed sub-cable of said plurality of sub-cables is substantially equal to a length of a second signal transmitting path from said second signal contact to said cable via said junction substrate and another exposed sub-cable of said plurality of sub-cables.

3. A connector to balance transmission comprising:

a cable to balance transmission;

a plug to balance transmission;

a junction substrate, to one end of which said plug is connected, and to the other end of which the cable to balance transmission is connected; and a shielding cover covering said junction substrate, a portion of said plug connected to said junction substrate and a portion of said cable connected to said junction substrate, wherein:

said cable comprises a plurality of sub-cables, each of which comprises a pair of leads to balance transmission, said plug comprises a pair of first and second signal contacts corresponding to the pair of leads of each of said plurality of sub-cables, respectively, and a length of a first signal transmitting path from said first signal contact to said cable via said junction substrate is substantially equal to a length of a second signal transmitting path from said second signal contact to said cable via said junction substrate.

4. A connector to balance transmission comprising:

a plug to balance transmission;

a junction substrate, to one end of which said plug is connected, and to the other end of which a cable to balance transmission is connected; and a shielding cover covering said junction substrate, a portion of said plug connected to said junction substrate, and a portion of said cable connected to said junction substrate, wherein:

said cable comprises a plurality of sub-cables, each of which comprises a pair of leads to balance transmission, said plug comprises a pair of first and second signal contacts corresponding to the pair of leads of each of said plurality of sub-cables, respectively, said plurality of sub-cables being exposed from the end of said cable and connected to said other end of said junction substrate, and a length of a first signal transmitting path from said first signal contact to said cable via said junction substrate and an exposed sub-cable of said plurality of sub-cables is substantially equal to a length of a second signal transmitting path from said second signal contact to said cable via said junction substrate and another exposed sub-cable of said plurality of sub-cables.

5. A plug to balance transmission, comprising:

a housing made of synthetic resin;

alternately arranged ground contacts and pairs of signal contacts; and two shielding plates incorporated into said housing oppositely, wherein:

each pair of said pairs of signal contacts has first and second leg portions between which an end of a printed-circuit board is inserted, where lengths of said first and second leg portions of each pair of said pairs of signal contacts being equal to one another, each of said ground contacts has leg portions between which said end of said printed-circuit board is inserted, and said two shielding plates have leg portions between which said end of said printed-circuit board is inserted.

6. A plug to balance transmission, comprising:

a housing made of synthetic resin;

alternately arranged ground contacts and pairs of signal contacts; and two shielding members incorporated into said housing oppositely, wherein:

each pair of said pairs of signal contacts has first and second leg portions between which an end of a printed-circuit board is inserted, where lengths of said first and second leg portions of each pair of said pairs of signal contacts being equal to one another, each of said ground contacts has leg portions between which said end of said printed-circuit board is inserted, and said two shielding members have shielding-plate portions which are inserted into said housing, and covering portions which cover said first and second leg portions of each pair of said pairs of signal contacts and said leg portions of each of said ground contacts when said shielding-plate portions are inserted into said housing.

7. A balanced-transmission cable-and-connector unit comprising:

a junction substrate comprising electric conductors;

a plug connected to said junction substrate; and a cable also connected to said junction substrate, wherein:

said plug comprises pairs of signal contacts, the signal contacts of each pair thereof being located on an obverse surface and a reverse surface of said junction substrate, respectively, said cable comprises a plurality of sub-cables, each of said plurality of sub-cables comprising a pair of leads, and said junction substrate has a multi-layer structure and connects using the electric conductors the pair of leads of each one of said plurality of sub-cables of said cable with a respective pair of said pairs of signal contacts of said plug through signal transmitting paths, respectively, using an internal portion of said junction substrate, where lengths of said signal transmitting paths being substantially equal to one another.

8. The balanced-transmission cable-and-connector unit as claimed in claim 7, wherein:

said internal portion of said junction substrate, having the multi-layer structure, comprises internal layers, and said junction substrate connects the pair of leads of each one of said plurality of sub-cables of said cable with a respective pair of said pairs of signal contacts of said plug through said internal layers, respectively.

9. A connector to balance transmission comprising:

a plug; and a junction substrate comprising electric conductors, to which said plug and a cable to balance transmission are connected;

wherein:

said plug comprises pairs of signal contacts, the signal contacts of each pair thereof being located on an obverse surface and a reverse surface of said junction substrate, respectively, said cable comprises a plurality of sub-cables, each of said plurality of sub-cables comprising a pair of leads, and said junction substrate has a multi-layer structure and connects using the electric conductors the pair of leads of each one of said plurality of sub-cables of said cable with a respective pair of said pairs of signal contacts of said plug through signal transmitting paths, respectively, using an internal portion of said junction substrate, where lengths of said signal transmitting paths are substantially equal to one another.

10. The connector as claimed in claim 9, wherein:

said internal portion of said junction substrate, having the multi-layer structure, comprises internal layers, and said junction substrate connects the pair of leads of each one of said plurality of sub-cables of said cable with a respective pair of said pairs of signal contacts of said plug through said internal layers, respectively.

11. The connector as claimed in claim 10, wherein said junction substrate has pairs of signal pads, each pair of said pairs of signal pads comprising one pad on the obverse surface of said substrate and the other pad on the reverse surface of said substrate, and having the respective pair of said pairs of signal contacts of said plug connected thereto, respectively, said junction substrate further having pairs of lead connection pads, each pair of said pairs of lead connection pads having the pair of leads of a respective one of said plurality of sub-cables of said cables connected thereto, respectively, said junction substrate further having a first wiring member which connects one pad of each pair of said pairs of lead connection pads with the obverse-surface-side pad of a respective pair of said pairs of signal pads using an internal layer of said junction substrate and a second wiring member which connects the other pad of the pair of said pairs of lead connection pads with the reverse-surface-side pad of the pair of said pairs of signal pads using another internal layer of said junction substrate, the length of said first wiring member being substantially equal to the length of said second wiring member.

12. A balanced-transmission connector comprising:

a plug part to be connected to a jack;

a balanced transmission cable;

a junction substrate of an electrical connection between said plug part and said balanced-transmission cable; and a shielding cover covering said plug part and said junction substrate, wherein said balanced-transmission cable comprises a plurality of sub-cables, each of which comprises a pair of leads to balance transmission, said plug comprises a pair of first and second signal contacts corresponding to the pair of leads of each of said plurality of sub-cables, respectively, and said connector has a configuration symmetrical with respect to a virtual grand plane of signals transmitted by said connector having opposite polarities.

13. The connector as claimed in claim 12, wherein said junction substrate extends for a length to allow core conductors of said balanced-transmission cable to be connected thereto to properly lie thereon so as to maintain a balanced characteristic of said balanced-transmission cable.

14. The connector as claimed in claim 12, comprising a configuration where a ground conductor of said balanced-transmission cable is electrically connected with said shielding cover.

15. The connector as claimed in claim 12, wherein said shielding cover completely covers said plug part at least with respect to directions perpendicular to the axial direction of said plug part.

16. The connector as claimed in claim 12, comprising a configuration such that paths of electrical wiring are equal in length between those transmitting the electrical signals having the opposite polarities.

* * * * *

UNITED STATES PATENT AND TRADEMARK OFFICE

CERTIFICATE OF CORRECTION

PATENT NO. : 6,685,511 B2
DATED : February 3, 2004
INVENTOR(S) : Junichi Akama et al.

It is certified that error appears in the above-identified patent and that said Letters Patent is hereby corrected as shown below:

Column 15,
Lines 15-23, replace the last paragraph of claim 7 with the following:

-- said junction substrate has a multi-layer structure and connects to the plug by connecting the electric conductors and the pair of leads of each one of said plurality of sub-cables with a respective pair of said pairs of signal contacts through signal transmitting paths, using an internal portion of said junction substrate, where lengths of said signal transmitting paths are substantially equal to one another. --

Lines 46-54, replace the last paragraph of claim 9 with the following:

-- said junction substrate has a multi-layer structure and connects to the plug by connecting the electric conductors and the pair of leads of each one of said plurality of sub-cables with a respective pair of said pairs of signal contacts through signal transmitting paths, using an internal portion of said junction substrate, where lengths of said signal transmitting paths are substantially equal to one another. --

Signed and Sealed this

Eighteenth Day of May, 2004

JON W. DUDAS
*Acting Director of the United States Patent and Trademark Office*